US011492221B2

(12) United States Patent
Hege

(10) Patent No.: US 11,492,221 B2
(45) Date of Patent: Nov. 8, 2022

(54) AGITATOR AND SHEET TRANSPORT DEVICE INCLUDING THE AGITATOR

(71) Applicant: A. G. Stacker, Inc., Weyers Cave, VA (US)

(72) Inventor: Dalton Hege, Weyers Cave, VA (US)

(73) Assignee: A.G. STACKER INC., Weyers Cave, VA (US)

( * ) Notice: Subject to any disclaimer, the term of this patent is extended or adjusted under 35 U.S.C. 154(b) by 142 days.

(21) Appl. No.: 17/104,009

(22) Filed: Nov. 25, 2020

(65) Prior Publication Data

US 2022/0161514 A1 May 26, 2022

(51) Int. Cl.

| | |
|---|---|
| ***B65H 5/06*** | (2006.01) |
| ***B31B 50/14*** | (2017.01) |
| ***B31B 50/04*** | (2017.01) |
| ***B31B 50/74*** | (2017.01) |
| ***B65H 29/20*** | (2006.01) |
| ***B65H 29/12*** | (2006.01) |
| *B31B 50/20* | (2017.01) |

(52) U.S. Cl.

CPC ..... *B65H 5/06* (2013.01); *B31B 50/042* (2017.08); *B31B 50/142* (2017.08); *B31B 50/74* (2017.08); *B65H 29/12* (2013.01); *B65H 29/20* (2013.01); *B31B 50/146* (2017.08); *B31B 50/20* (2017.08); *B65H 2301/51115* (2013.01); *B65H 2404/122* (2013.01); *B65H 2404/261* (2013.01); *B65H 2404/262* (2013.01); *B65H 2515/50* (2013.01); *B65H 2701/1762* (2013.01); *B65H 2801/42* (2013.01)

(58) Field of Classification Search

CPC ..... B65H 2404/121; B65H 2404/122; B65H 2404/12; B65H 2404/1521; B65H 5/06; B65H 2301/51115; B27D 7/18; B27D 7/1818

See application file for complete search history.

(56) References Cited

U.S. PATENT DOCUMENTS 4,437,658 A * 3/1984 Olson ..... B65H 3/063 271/146

* cited by examiner

*Primary Examiner* — Jeremy R Severson
(74) *Attorney, Agent, or Firm* — J-Tek Law PLLC; Jeffrey D. Tekanic; Scott T. Wakeman

(57) ABSTRACT

An agitator for agitating sheets of material passing through a sheet transport device that has upper and lower guide sections defining a sheet transport path therebetween. The agitator includes first and second sets of rollers each having a roller axis of rotation and a width, and the rollers are mounted to at least one holder such that the axes of rotation of the rollers are radially spaced from a line and such that rotating the at least one holder around the line causes the rollers to orbit around the line. At least one support supports the holder for rotation around the line, and the set of first rollers is spaced from the set of second rollers in the direction of the line by a distance greater than the width of the rollers. Also a sheet transport device including the agitator.

20 Claims, 4 Drawing Sheets

AGITATOR AND SHEET TRANSPORT DEVICE INCLUDING THE AGITATOR

TECHNOLOGICAL FIELD

The present disclosure is directed to an agitator for agitating sheets of material moving through a sheet transport device and to a sheet transport device including the agitator, and, more specifically, to an agitator configured to make direct contact with sheets of material moving through a sheet transport device and to a sheet transport device including the agitator.

BACKGROUND

Rotary die cut machines may be used to produce flat blanks or sheets of paperboard or other material that are scored so that they can be folded into a finished product, a box, for example. The blanks output from the rotary die cut machine generally must be transferred from the die cut machine to another processing apparatus such as a stacker. A conveyor device referred to as a "layboy" may be placed at the output of the rotary die cut machine to carry the blanks to the stacker.

Rotary die cut machines produce a certain amount of scrap material during operation which consists mainly of the portions of the input material that do not become part of a finished blank. In addition, each blank may include slots or through-openings. The material cut from the blanks to form these slots and through-openings also constitutes scrap.

Most scrap material produced by the die cut machine drops beneath or immediately in front of the die cut machine as it operates. However, it is not uncommon for a material sheet to be cut incompletely so that portions of the sheet that were supposed to be removed wind up traveling into the sheet transport device with the blank. Excessive scrap in the transport path between the sheet transport device and the final stack of blanks may adversely affect the transport of the blanks. That is, the scrap may interfere with the alignment of the blanks or lead to jams. Alternately, if the scrap is carried all the way through the stacker and into the final stack of blanks, the blanks in the stack will have gaps therebetween where the scrap material is present thus resulting in a crooked, or oversized or non-uniform stack of blanks. Some scrap may even end up inside a finished box formed from the cut blanks; this is generally undesirable to most end customers and must be completely avoided in some applications, such as boxes for use to package food.

It is known to use an agitator to repeatedly impact the bottoms of the lower belts of a layboy to shake some of the scrap material from the sheets traveling through the layboy. A layboy 10 having a conventional agitator 12 is illustrated in FIGS. 4-6. The layboy 10 includes a upper guide section 14 comprising a plurality of upper belts 16 and a lower guide section 18 comprising a plurality of lower belts 20, and lower surfaces of the upper belts 16 and the upper surfaces of the lower belts 20 define a sheet transport path 22 therebetween. The sheet transport path 22 extends in a sheet transport direction 24 from an input end 26 to an output end 28 of the layboy.

The agitator 12 is mounted to the layboy 10 inside the closed path formed by the lower belts 20 and comprises a central shaft 30 having an axis of rotation 32 transverse to the sheet transport direction 24. A first support disk 34 is mounted at one end of the shaft 30, a second support disk 36 is mounted at the opposite end of the shaft 30 and middle support disk 38 is mounted in the middle of the shaft 30. The first, second and middle support disks 34, 36, 38 are each provided with a plurality of bosses 40, and a first plurality of tubes 42 are journaled on the bosses 40 so that they extend between the first support disk 34 and the middle support disk 38, and a second plurality of the tubes 42 are journaled on the bosses 40 so that they extend between the middle support disk 38 and the second support disk 36. The tubes are freely rotatable on the bosses.

The central shaft 30 is mounted relative to the upper portions of the lower belts 20 so that at the central shaft 30 is rotated, the tubes 42 periodically impact against the bottoms of the upper portions of the lower belts 20. These impacts cause the lower belts to rise and fall and shake the sheets as they move over the agitator 12 to dislodge scrap material therefrom.

While such agitators are useful, the fact that the sheets are in contact with upper and lower sets of belts as they travel through a layboy complicates the removal of scrap, especially scrap that is held against the sheets by the belts. It is therefore known to include an additional sheet transport device between a layboy and a stacker to remove additional scrap from the sheets of material. One such sheet transfer device is disclosed in U.S. Pat. No. 10,071,873, assigned to the present applicant, which is incorporated herewith in its entirety. This device uses wheels instead of belts to support the bottoms of the sheets, and the wheels make it easier to remove scrap from the sheets. Fans and/or brushes may also be used to dislodge loose or partially attached scrap material. It would be useful to agitate the sheets as the travel through such a sheet transfer device. However, the lack of belts and the close spacing of the support wheels means that a conventional agitator as discussed above cannot be used.

It would therefore be desirable to provide an agitator that is suitable for use with sheet transport devices that do not use belts to form the upper and/or lower guide sections of the device and a sheet transfer device that include such an agitator.

SUMMARY

These and other problems are addressed by embodiments of the present invention, a first aspect of which comprises an agitator for agitating sheets of material passing through a sheet transport device in a sheet transport direction from an input end to an output end, the sheet transport device having an upper guide section comprising a first plurality of wheels or belts and a lower guide section comprising a second plurality of wheels or belts, the upper and lower guide sections defining a sheet transport path therebetween. The agitator comprises a set of first rollers each having a roller axis of rotation and a first width, the first rollers being mounted to at least one first holder such that the axes of rotation of the first rollers are radially spaced from a line and such that rotating the at least one first holder around the line causes the set of first rollers to orbit around the line, and a set of second rollers each having a roller axis of rotation and a second width, the second rollers being mounted to at least one second holder such that the axes of rotation of the second rollers are radially spaced from the line and such that rotating the at least one second holder around the line causes the set of second rollers to orbit around the line. The agitator also includes at least one support supporting the at least one first holder and the at least one second holder for rotation around a line, and the set of first rollers is spaced from the set of second rollers in the direction of the line by a distance greater than the first width.

Another aspect of the invention comprises a sheet transport device for carrying sheets in a sheet transport direction from an input end to an output end. The sheet transport device includes an upper guide section comprising a plurality of upper wheels or upper belts and a lower guide section comprising a plurality of lower wheels, the tops of the lower wheels being bounded by a first imaginary plane. The lower surfaces of the upper wheels or belts and the first imaginary plane defining a sheet transport path therebetween. The device also includes an agitator configured to agitate the sheets in the sheet transport path. The agitator includes a set of first rollers each having a roller axis of rotation and a first width, and the first rollers are mounted to at least one first holder such that the axes of rotation of the first rollers are radially spaced from a line and such that rotating the at least one first holder around the line causes the set of first rollers to orbit around the line. The agitator also includes a set of second rollers each having a roller axis of rotation and a second width, and the second rollers are mounted to at least one second holder such that the axes of rotation of the second rollers are radially spaced from the line and such that rotating the at least one second holder around the line causes the set of second rollers to orbit around the line. At least one support supports the at least one first holder and the at least one second holder for rotation around the line, and the at least one support is located at a lower side of the sheet transport path. The first set of rollers and the second set of rollers and the at least one support are arranged and configured such that the rollers of the first and second sets of rollers pass through the first imaginary plane and into the sheet transport path when the first holder and the second holder rotate around the line.

BRIEF DESCRIPTION OF THE DRAWINGS

These and other aspects and benefits of the disclosure will be better understood after a reading of the following detailed description in connection with the attached drawings in which.

DETAILED DESCRIPTION

Figure 1:
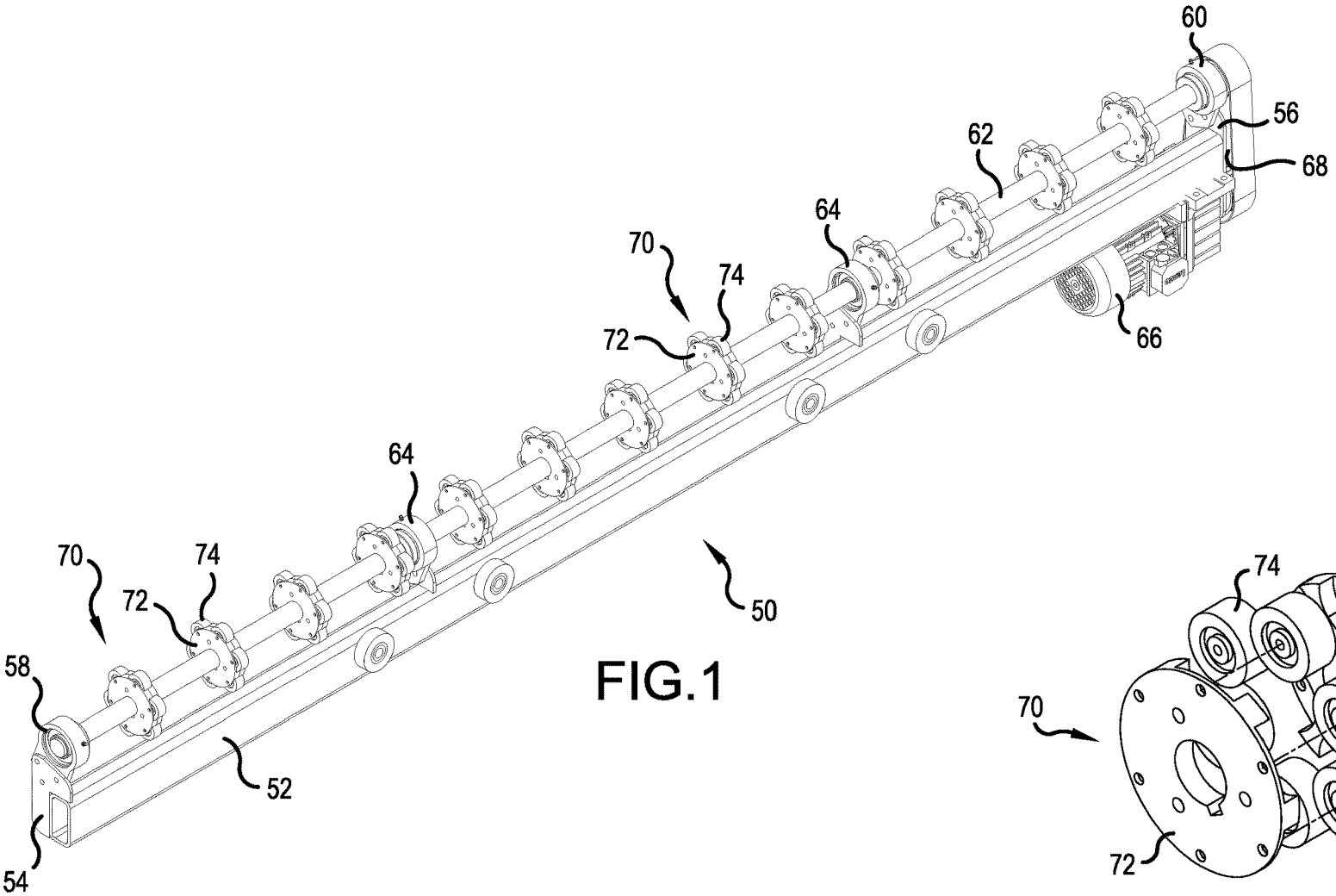
FIG. 1 is a perspective view of an agitator according to an embodiment of the present disclosure that includes a plurality of roller sets arranged along a support.

Referring now to the drawings, wherein the showings are for the purpose of illustrating presently preferred embodiments of the invention only and not for limiting same, FIG. 1 shows an agitator 50 according to an embodiment of the present invention. The agitator 50 includes a support beam 52 having a first end bracket 54 mounted at one end and a second end bracket 56 mounted at a second end. A first bearing 58 is mounted on the first end bracket 54 and a second bearing 60 is mounted on the second end bracket 56. A shaft 62 is rotatably supported by the first and second bearings 58, 60, and two intermediate bearings 64 mounted to the support beam 52 support central portions of the shaft 62. Each of the foregoing bearings may be, for example, a plain bearing or a rolling bearing.

A drive 66 is operably connected to the shaft 62, by a belt or chain 68, for example, to rotate the shaft 62 in the first and second bearings 58, 60 and the intermediate bearings 64. The drive is supported by the support beam 52 so that the entire agitator 50 can be installed as a unit.

A plurality of roller sets 70 are mounted along the shaft 62. Each of the roller sets 70 comprises first and second spaced roller plates 72 fixedly mounted to the shaft 62 for rotation therewith and a set of rollers 74 supported by the roller plate 72 for free rotation relative to the roller plates 72. Each pair of the first and second spaced roller plates 72 may sometimes be referred to herein as a "holder" for the rollers.

Figure 2:
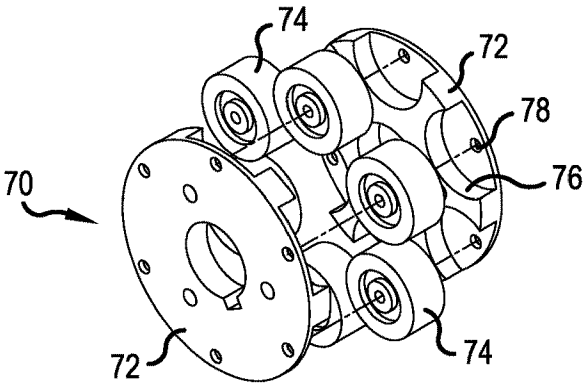
FIG. 2 is an exploded view of one of the roller sets of FIG. 1.

FIG. 2 shows one of the roller sets 70 of FIG. 1 in exploded view. Each of the roller plates 72 includes a plurality of curved recesses 76 that extend radially inward into each of the roller plates 72 from a periphery thereof, and an opening 78 is formed in each of the recesses 76. One of the rollers 74 is mounted in each adjacent pair of the recesses 76 on roller axles 80 that extend between axially aligned ones of the openings 78 in a pair of the roller plates 72. At least the surfaces of the rollers 74 are formed from a polymer for example, an acetyl homopolymer such as the product sold by DuPont under the trademark Delrin. The openings 78 are mounted close to the peripheral edges of the roller plates 72 such that slightly less than half of each of the rollers 74 projects beyond the periphery of the roller plates 72. The openings 78 in the plates 72 are spaced the same distance from the axis of rotation of the shaft 62, and the rollers 74 preferably have the same outer diameters; therefore the rollers 74 all lie inside and tangent to an imaginary circle.

Figure 3:
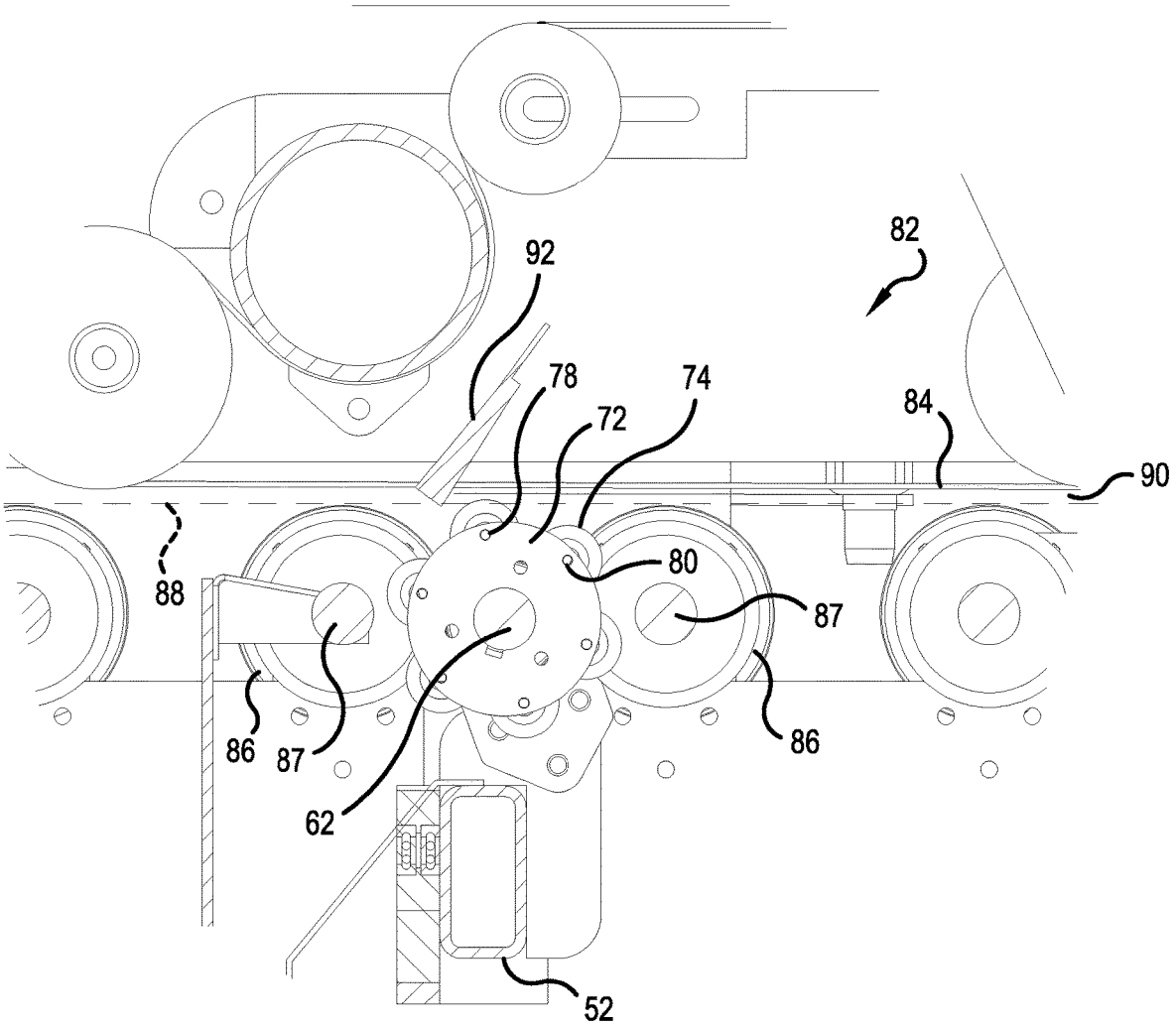
FIG. 3 is a sectional side elevational view of the agitator of FIG. 1 mounted in the lower guide section of a sheet transport device.
Figure 4:
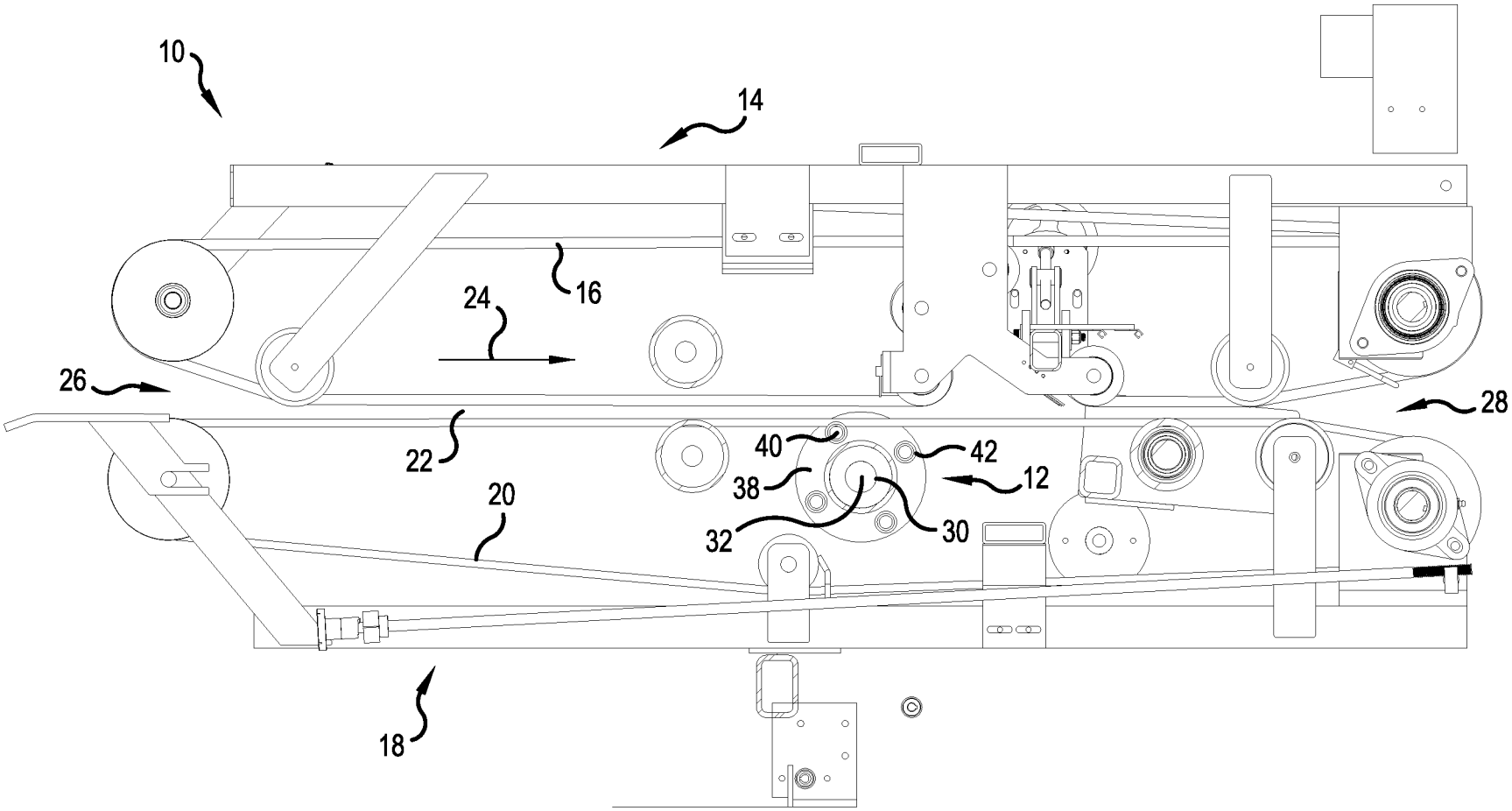
FIG.4 CONVENTIONAL ART
FIG. 4 is a side elevational view of a layboy that includes a conventional agitator.
Figures 5, 6:
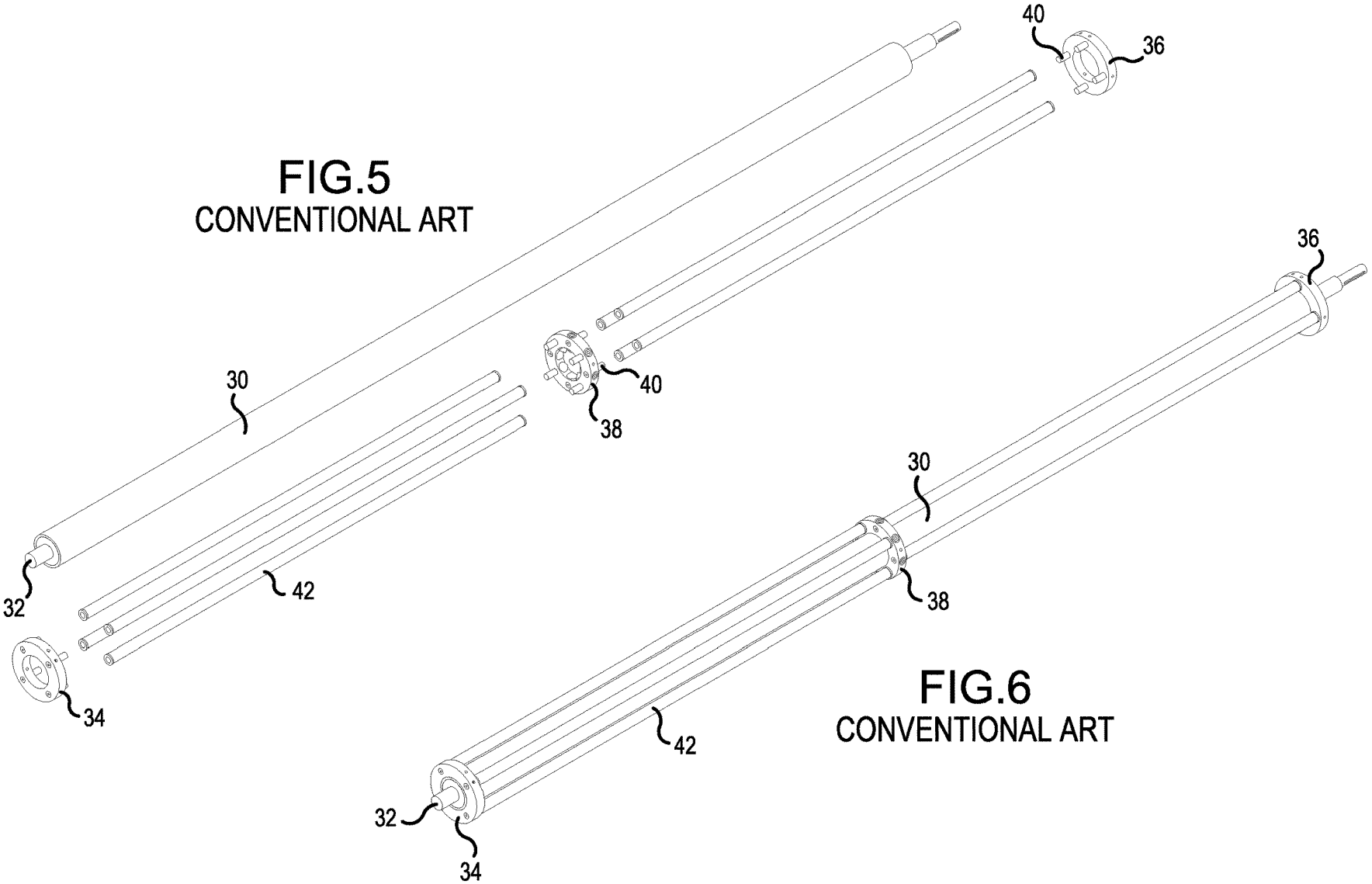
FIG.5 CONVENTIONAL ART
FIG.6 CONVENTIONAL ART
FIG. 5 is an exploded perspective view of the conventional agitator of FIG. 4.
FIG. 6 is a perspective view of the agitator of FIG. 5 in an assembled state.

The agitator 50 is mounted in a sheet transport device 82 as illustrated in FIG. 3. The sheet transport device includes upper belts 84 configured to contact the upper surfaces of sheets moving through the sheet transport device 82 and a plurality of lower wheels 86 mounted on support axles 87, the tops of which lower wheels 86 form a support surface for supporting the sheets moving through the sheet transport device 82. The tops of the lower wheels 86 are bounded by an imaginary plane 88, and the imaginary plane 88 and the lower surfaces of the upper belts 84 define a sheet transport path 90 therebetween along which the sheets of material travel in a sheet transport direction through the sheet transport device 82. A brush 92 may be provided that extends into the sheet transport path 90 to help dislodge scrap from the sheets.

The shaft 62 of the agitator 50 extends transversely to the sheet transport direction and is mounted relative to the imaginary plane 88 such that the imaginary circle bounding the rollers 74 intersects the imaginary plane 88. In other words, portions of the rollers 74 travel through the imaginary plane 88 as the shaft 62 rotates. The shaft 62 is preferably mounted between pairs of the support axles 87 in the sheet transport direction so that the shaft 62 and the support axles are approximately the same distance below the imaginary plane 88. The imaginary circle overlaps the lower wheels 86 when viewed in a direction of the shaft 62, that is a direction perpendicular to the sheet transport direction.

In operation, the upper belts 84 and the lower wheels 86 of the sheet transport device 82 are operated in a conventional manner to carry sheets of material along the sheet transport path. During this operation, the agitator 50 operates, as discussed below, to jostle the sheets in the sheet transport path to dislodge scrap material therefrom. Specifically, the drive 66 is operated to cause the shaft 62 to rotate, preferably so that the top of the shaft 62 moves in a direction opposite to the direction of rotation of the lower wheels 86, and this causes the rollers 74 to orbit around the axis of rotation of the shaft 62. At top of their orbits, the rollers 74 extend through the imaginary plane 88 and directly impact against sheets of material traveling through the sheet transport device 82.

The rollers 74 are lightweight and preferably have a narrow width relative to the width of the sheets being transported and they therefore have a relatively low moment of inertia and require little energy to be set in motion. Therefore, when the rollers engage the bottoms of the sheets moving along the sheet transport path they do not interfere significantly with the forward movement of the sheets or damage the surfaces of the sheets. Instead, the rollers 74 rotate when they contact the moving sheets to allow the sheets to continue forward with relatively little resistance while the vertical component of the force imparted to the rollers by the rotation of the roller supports jogs the sheet upward to loosen and/or dislodge material therefrom. If a brush 92 is present, it is preferably located above the agitator 50 and cooperates with the agitator to loosen and remove scrap material. In this manner, all or at least a greater percentage of any scrap in the sheet transport path can be removed that would have been removed by a conventional layboy using a conventional agitator.

The present invention has been described herein in terms of a presently preferred embodiment. Modifications and additions to this embodiment will become apparent to persons of ordinary skill in the art upon a reading of the foregoing description. It is intended that all such modifications and additions form a part of the present invention to the extent they fall within the scope of the several claims appended hereto.

What is claimed is:

1. An agitator for agitating sheets of material passing through a sheet transport device in a sheet transport direction from an input end to an output end, the sheet transport device having an upper guide section comprising a first plurality of wheels or belts and a lower guide section comprising a second plurality of wheels or belts, the upper and lower guide sections defining a sheet transport path therebetween, the agitator comprising:

a set of first rollers each having a roller axis of rotation and a first width, the first rollers being mounted to at least one first holder such that the axes of rotation of the first rollers are radially spaced from a line and such that rotating the at least one first holder around the line causes the set of first rollers to orbit around the line, a set of second rollers each having a roller axis of rotation and a second width, the second rollers being mounted to at least one second holder such that the axes of rotation of the second rollers are radially spaced from the line and such that rotating the at least one second holder around the line causes the set of second rollers to orbit around the line, and at least one support supporting the at least one first holder and the at least one second holder for rotation around the line, wherein the line extends in a direction, wherein the set of first rollers is spaced from the set of second rollers in the direction of the line by a distance greater than the first width, wherein the first holder comprises a first plate and a second plate connected to the at least one support, wherein the set of first rollers are rotatably supported between the first and second plates, wherein the first holder includes a plurality of curved recesses extending radially into the first holder from a periphery of the first holder, and wherein the set of first rollers are mounted in the recesses.

2. The agitator according to claim 1, wherein the at least one support comprises at least one shaft having a longitudinal axis lying on the line.

3. The agitator according to claim 2, wherein the at least one first holder and the at least one second holder are fixed to the shaft.

4. A sheet transport device comprising:

a frame; and the agitator according to claim 1 mounted to the frame such that the line is perpendicular to the sheet transport direction.

5. The sheet transport device according to claim 4, wherein the second plurality of wheels or belts comprises the plurality of wheels, and wherein each of the wheels has a peripheral surface defining a portion of the sheet transport path.

6. The sheet transport device according to claim 5, wherein the plurality of wheels are supported by at least two shafts extending in the direction and wherein the at least one first holder overlaps the plurality of wheels when viewed in the direction.

7. The agitator according to claim 1, wherein the plurality of curved recesses are located in the first plate and/or the second plate.

8. A sheet transport device for carrying sheets in a sheet transport direction from an input end to an output end, the sheet transport device comprising:

an upper guide section comprising a plurality of upper wheels or upper belts and a lower guide section comprising a plurality of lower wheels, the tops of the lower wheels being bounded by a first imaginary plane, the lower surfaces of the upper wheels or belts and the first imaginary plane defining a sheet transport path therebetween, an agitator configured to agitate the sheets in the sheet transport path, the agitator comprising:

a set of first rollers each having a roller axis of rotation and a first width, the first rollers being mounted to at least one first holder such that the axes of rotation of the first rollers are radially spaced from a line and such that rotating the at least one first holder around the line causes the set of first rollers to orbit around the line, a set of second rollers each having a roller axis of rotation and a second width, the second rollers being mounted to at least one second holder such that the axes of rotation of the second rollers are radially spaced from the line and such that rotating the at least one second holder around the line causes the set of second rollers to orbit around the line, and at least one support supporting the at least one first holder and the at least one second holder for rotation around the line, wherein the line extends in a direction, wherein the at least one support is located at a lower side of the sheet transport path, wherein the first set of rollers and the second set of rollers and the at least one support are arranged and configured such that the rollers of the first and second sets of rollers pass through the first imaginary plane and into the sheet transport path when the first holder and the second holder rotate around the line, wherein the rollers of the first set of rollers are circumscribed by an imaginary circle, and wherein the circle overlaps at least two of the lower wheels when viewed in the direction.

9. A sheet transport device for carrying sheets in a sheet transport direction from an input end to an output end, the sheet transport device comprising:

an upper guide section comprising a plurality of upper wheels or upper belts and a lower guide section comprising a plurality of lower wheels, the tops of the lower wheels being bounded by a first imaginary plane, the lower surfaces of the upper wheels or belts and the first imaginary plane defining a sheet transport path therebetween, an agitator configured to agitate the sheets in the sheet transport path, the agitator comprising:

a set of first rollers each having a roller axis of rotation and a first width, the first rollers being mounted to at least one first holder such that the axes of rotation of the first rollers are radially spaced from a line and such that rotating the at least one first holder around the line causes the set of first rollers to orbit around the line, a set of second rollers each having a roller axis of rotation and a second width, the second rollers being mounted to at least one second holder such that the axes of rotation of the second rollers are radially spaced from the line and such that rotating the at least one second holder around the line causes the set of second rollers to orbit around the line, and at least one support supporting the at least one first holder and the at least one second holder for rotation around the line, wherein the line extends in a direction, wherein the at least one support is located at a lower side of the sheet transport path, and wherein the first set of rollers and the second set of rollers and the at least one support are arranged and configured such that the rollers of the first and second sets of rollers pass through the first imaginary plane and into the sheet transport path when the first holder and the second holder rotate around the line, wherein the line lies in a second imaginary plane parallel to the sheet transport path, wherein the wheels of the lower guide section are mounted on a plurality of wheel support shafts, and wherein the second imaginary plane intersects at least two of the plurality of wheels.

10. The sheet transport device according to claim 9, wherein the first set of rollers and the second set of rollers and the at least one support are arranged and configured such that axes of rotation of the first and second sets of rollers are always located on the lower side of the first imaginary plane.

11. The sheet transport device according to claim 9, wherein the first holder is spaced from the second holder by a distance greater than the first width.

12. The sheet transport device according to claim 9, wherein the line is perpendicular to the sheet transport direction.

13. The sheet transport device according to claim 9, wherein the first holder comprises a plate connected to the at least one support, and wherein the first rollers are supported for rotation relative to the plate.

14. The sheet transport device according to claim 9, wherein the first holder comprises a first plate and a second plate connected to the at least one support, and wherein the first rollers are rotatably supported between the first and second plates.

15. The sheet transport device according to claim 14, wherein the first and second plates each include a plurality of curved recesses extending radially into the respective plate from a periphery of the respective plate, and wherein the first and second rollers are mounted in the recesses.

16. The sheet transport device according to claim 9, including a drive configurated to rotate the at least one support.

17. The sheet transport device according to claim 9, wherein the first rollers are rotatable independently of one another.

18. A method of agitating sheets of material comprising:

providing the sheet transport device according to claim 9;

transporting the sheets through the sheet transport device;

rotating the shaft to periodically move the rollers of the first and second sets of rollers into direct contact with the sheets traveling along the sheet transport path.

19. The sheet transport device according to claim 9, wherein the second imaginary plane intersects at least two of the wheel support shafts.

20. The sheet transport device according to claim 9, wherein the rollers of the first set of rollers are circumscribed by an imaginary circle, and wherein the circle overlaps at least two of the lower wheels when viewed in the direction.

* * * * *